US008798298B1

(12) United States Patent
Burns et al.

(10) Patent No.: US 8,798,298 B1
(45) Date of Patent: Aug. 5, 2014

(54) CONSTRAINED LAYER DAMPING FOR HEARING ASSISTANCE DEVICES

(75) Inventors: Thomas Howard Burns, St. Louis Park, MN (US); Andrew Beeson, Plymouth, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1260 days.

(21) Appl. No.: 12/644,204

(22) Filed: Dec. 22, 2009

Related U.S. Application Data

(60) Provisional application No. 61/142,178, filed on Dec. 31, 2008.

(51) Int. Cl.
*H04R 25/00* (2006.01)

(52) U.S. Cl.
USPC ..... 381/318; 381/322; 381/328; 264/267; 264/272.14; 264/272.15; 264/273; 264/275

(58) Field of Classification Search
USPC ..... 381/312–331; 264/267, 239, 222, 264/272.13–272.15, 275, 273; 29/896.21
See application file for complete search history.

(56) References Cited

U.S. PATENT DOCUMENTS

| | | | | | |
|---|---|---|---|---|---|
| 4,871,502 | A * | 10/1989 | LeBisch et al. | ..... | 264/222 |
| 4,962,537 | A * | 10/1990 | Basel et al. | ..... | 381/324 |
| 5,006,055 | A * | 4/1991 | Lebisch et al. | ..... | 425/2 |
| 7,130,437 | B2 * | 10/2006 | Stonikas et al. | ..... | 381/322 |
| 7,998,391 | B1 * | 8/2011 | Koo | ..... | 264/255 |
| 2005/0141739 | A1 * | 6/2005 | Juneau et al. | ..... | 381/322 |
| 2011/0079227 | A1 * | 4/2011 | Turcot et al. | ..... | 128/865 |

* cited by examiner

*Primary Examiner* — Davetta W Goins
*Assistant Examiner* — Jasmine Pritchard
(74) *Attorney, Agent, or Firm* — Schwegman, Lundberg & Woessner, P.A.

(57) ABSTRACT

Disclosed herein, among other things, is a system for constrained layer damping for hearing assistance devices. According to various embodiments, a hollow in-the-ear (ITE) hearing instrument shell is formed. The shell has an air space within a wall of the shell, in various embodiments. A port is created in the wall of the shell. The port is adapted to interface the air space to an area outside the shell, in an embodiment. A viscous fluid is dispensed into the air space via the port, and the viscous fluid is cured within the air space. The cured fluid acts as a constrained layer of mechanical damping within the wall of the ITE shell, reducing audible feedback to a wearer of the ITE.

20 Claims, 3 Drawing Sheets

CONSTRAINED LAYER DAMPING FOR HEARING ASSISTANCE DEVICES

CLAIM OF PRIORITY

The present application claims the benefit under 35 U.S.C. 119(e) of U.S. Provisional Patent Application Ser. No. 61/142,178, filed Dec. 31, 2008, which is incorporated herein by reference in its entirety.

TECHNICAL FIELD

This disclosure relates generally to hearing assistance devices, and more particularly to a system for constrained layer damping for hearing assistance devices.

BACKGROUND

Hearing assistance devices, such as hearing aids or hearing instruments, include devices for use in the ear, in the ear canal, completely in the canal, and behind the ear. Such devices have been developed to ameliorate the effects of hearing losses in individuals. Hearing deficiencies can range from deafness to hearing losses where the individual has impairment responding to different frequencies of sound or to being able to differentiate sounds occurring simultaneously. The hearing assistance device in its most elementary form usually provides for auditory correction through the amplification and filtering of sound provided in the environment with the intent that the individual hears better than without the amplification.

High-gain hearing instruments are prescribed to individuals suffering from moderate to severe hearing loss. For high-gain instruments, where the acoustical feedback path has been reduced with acoustical seals and/or digital signal processing (DSP) algorithms, the mechanical path becomes the primary contributor to audible feedback. Audible feedback can include an annoying "whistle" that originates within the instrument itself. In the past, various shell fabrication strategies for in-the-ear (ITE) hearing devices have been used to mitigate mechanical feedback. Such strategies have included solid, elastomeric shell-housings that encapsulate the internal electrical components, for example, or hollow shells that have been coated with various elastomeric materials. In general, none of these approaches has provided a substantive reduction in mechanical feedback over a wide range of frequencies for all physiological shell geometries. Though they may provide benefit in one formant frequency region, mechanical feedback in other regions may become exacerbated, thereby reducing the overall usable gain for the user. A shell design and fabrication method is needed that would reduce mechanical feedback over a broad frequency range for any shell geometry.

SUMMARY

Disclosed herein, among other things, is a system for constrained layer damping for hearing assistance devices. According to various embodiments, the system includes a manufacturing apparatus adapted to form a hollow in-the-ear (ITE) hearing instrument shell having an air space within a wall of the shell. The shell has at least one port adapted to interface the air space to an area outside the shell, in an embodiment. The system also includes a dispensing apparatus adapted to interface with the port. The dispensing apparatus is further adapted to dispense a viscous fluid within the air space, in an embodiment. In various embodiments, the system includes a curing apparatus adapted to interface with the shell. The curing apparatus is adapted to cure the viscous fluid within the air space such that the cured fluid acts as a constrained layer of mechanical damping within the wall of the ITE shell. The constrained layer is adapted to reduce audible feedback to a wearer of the ITE.

Disclosed herein, among other things is an in-the-ear (ITE) hearing instrument. According to various embodiments, the hearing instrument includes a hollow plastic shell and an air space within a wall of the shell. The hearing instrument also includes at least one port in the shell. The port is adapted to interface the air space to an area outside the shell, in an embodiment. A viscous fluid is dispensed within the air space via the port. The fluid is adapted to be cured such that the cured fluid acts as a constrained layer of mechanical damping within the wall of the ITE shell, in various embodiments. The constrained layer adapted to reduce audible feedback to a wearer of the ITE.

Disclosed herein, among other things is a method for constrained layer damping for hearing assistance devices. According to various embodiments, a hollow in-the-ear (ITE) hearing instrument shell is formed. The shell has an air space within a wall of the shell, in various embodiments. A port is created in the wall of the shell. The port is adapted to interface the air space to an area outside the shell, in an embodiment. A viscous fluid is dispensed into the air space via the port, and the viscous fluid is cured within the air space. The cured fluid acts as a constrained layer of mechanical damping within the wall of the ITE shell, reducing audible feedback to a wearer of the ITE.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their equivalents.

BRIEF DESCRIPTION OF THE DRAWINGS

Various embodiments are illustrated by way of example in the figures of the accompanying drawings. Such embodiments are demonstrative and not intended to be exhaustive or exclusive embodiments of the present subject matter.

DETAILED DESCRIPTION

Figure 1A:
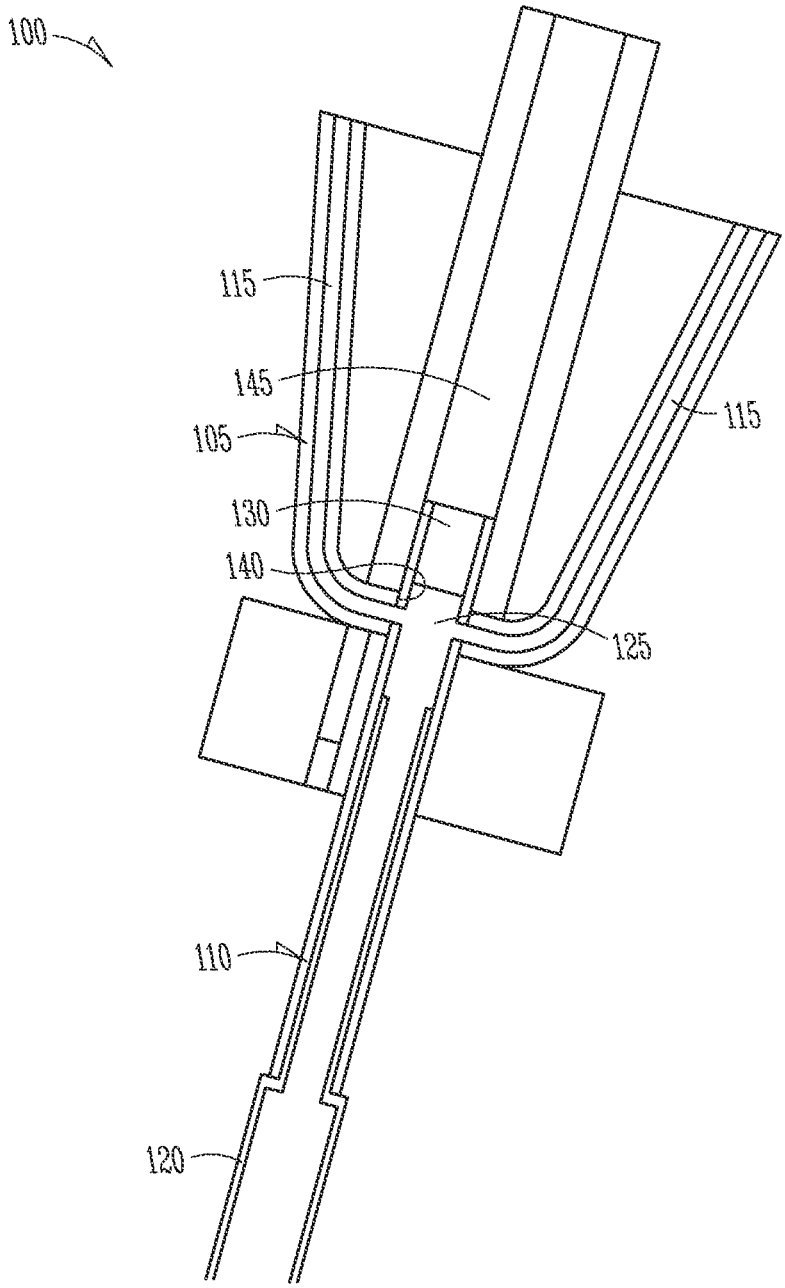
FIGS. 1A-1B illustrate a system for constrained layer damping for hearing assistance devices, according to one embodiment.

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

The present subject matter relates to a method and apparatus for reducing audible feedback in an in-the-ear (ITE) hearing instrument. A constrained layer for mechanical damping is provided within the shell walls of the ITE instrument. A rapid prototyping equipment, such as a stereo lithography apparatus (SLA) is used to create a plastic, hollow-walled ITE shell directly from computer aided design (CAD) geometry files. In various embodiments, the shell can be of any size. Viscous liquid is dispensed within the hollow walls of the ITE shell using a dispensing apparatus. The viscous liquid is cured into a thin, low-durometer, elastomeric layer. The purpose of the elastomeric layer is to damp mechanical vibration and thus reduce audible feedback to the wearer.

The system of the present subject matter can be formed using methods including, but not limited to, drilling, computer aided manufacturing, stereo lithography, and any other form of three dimensional manufacturing. In an embodiment, the device of the present subject matter (such as 105 in FIG. 1A) is formed using a stereo lithography apparatus (SLA). Forming the device using an SLA includes creating a three dimensional model of the device using a computer assisted drawing (CAD) program, in an embodiment. A software program is used to "slice" the CAD model into thin layers, such as five to ten layers per millimeter, in an embodiment. The SLA uses a specialized three-dimensional printer with a laser that forms one of the layers, exposing liquid plastic in the SLA's tank and hardening it. A moving platform within the tank drops down a fraction of a millimeter and the laser forms the next layer, in an embodiment. This process repeats, layer by layer, until the device is completely formed.

Modern techniques for creating hearing instrument shells for in-the-ear (ITE) hearing devices utilize digital fabrication processes. Hearing instrument manufacturers have adopted laser scanning of traditional impressions as a method of obtaining mathematical representations of the ear canal geometry. This geometry is manipulated within CAD software to fabricate a thin-walled, plastic shell using SLA processes. SLA technology has experienced continuous improvements in material strength and geometrical precision. These improvements have provided an opportunity to create new design strategies for reducing mechanical feedback. One such strategy is to create a hearing instrument shell with thin, hollow walls, and to incorporate a viscoelastic damping layer within the thin, hollow walls.

In traditional hearing instrument shells, mechanical bending waves propagate from the receiver to the microphone via a mechanical feedback path through the plastic walls, particularly at mid and high frequencies. Although DSP can be employed on board the hearing instrument to manage mechanical feedback, there would be an advantage in employing passive means to reduce this feedback with the choice and placement of materials. Optimizing a shell's mechanical properties passively would reduce the need and complexity of DSP—thereby freeing it up for other tasks. Viscoelastic constrained layer damping (CLD) is a passive technique that has had success in many vibration-control applications.

Mechanical vibration creates bending waves such that the maximum shear stress occurs along the neutral axis of a wall of the shell. For a homogeneous, symmetric shell, the neutral axis is located in the half-way region within the thickness of the wall. A highly damped, low-durometer, viscoelastic layer located in this region, and properly sandwiched between harder plastic walls, provides an efficient means to dissipate energy from the vibrational bending waves in the shell. Generally, damping is inversely proportional to the viscoelastic durometer. In various embodiments, low-durometer refers to a soft, compliant material.

SLA technology is used to create a tightly-toleranced, hollow-walled ITE shell, according to various embodiments. A dispenser apparatus is used to interface to the base of the ITE shell and inject a viscous fluid (e.g., the elastomer in a viscous phase) into the hollow walls of the shell. An ultraviolet (UV) light bath can be used to cure the viscous fluid into a low-durometer elastomer, in various embodiments. The cured elastomer is contained within the plastic shell walls such that the overall wall thickness has been kept nominally the same as traditional plastic ITE shells. In various embodiments, alternatives to the viscous fluid may include a heated hot-melt that hardens at room temperature, a silicone in an uncured state, or a UV curable adhesive in a liquid state.

As stated, various embodiments include a dispenser apparatus to interface to the base of the ITE shell and inject a viscous fluid upward into the hollow walls of the shell. In one embodiment, a glue dispenser is used to inject the viscous fluid. Other methods for filling the ITE shell include: a syringe, a nipple fitting (added to the shell geometry to enable interface for attachment and break off when complete), capillary action fill (partially submerge shell and allow capillary action to wick into shell gap), a submerged shell with vacuum/pressure applied, ultrasonic agitation of a submerged shell, inter-nesting shells (nested doll), 3-D printing or deposition printing, soft coating on interior shell, use of foams as constraining layer medium, chemical reaction at edge of shell (self-expanding polyfoam), two-part clam shell, three shell assembly, vapor deposition of elastomer, two-part primer flush and reaction material (gel, for example) added for reaction or accelerator, electrostatic/electrical plating/activation, doping of elastomer or shell plastic, thermo forming shell outer layer and vacu-forming inner layer with constrained layer damping, etching for constrained layer damping, blow molding or centrifuge filling. Thus, general methods for filling the shell for constrained layer damping include: spraying, pumping, injecting, pouring, wicking/capillary, dripping, draw/vacuum, dipping, coating, tape application and centrifuge. Other methods for filling the shell can be used without departing from the scope of this disclosure.

A system for constrained layer damping for hearing assistance devices is disclosed. According to various embodiments, the system includes a manufacturing apparatus adapted to form a hollow in-the-ear (ITE) hearing instrument shell having an air space within a wall of the shell. The shell has at least one port adapted to interface the air space to an area outside the shell, in an embodiment. In various embodiments, the air space thickness is approximately $\frac{1}{3}^{rd}$ the thickness of the entire shell, but can be between $\frac{1}{10}^{th}$ to $\frac{9}{10}$ths the thickness of the entire shell. Also, the air space exists within the entire shell walls of the ITE. The system also includes a dispensing apparatus adapted to interface with the port. The dispensing apparatus is further adapted to dispense a viscous fluid within the air space, in an embodiment. In various embodiments, the system includes a curing apparatus adapted to interface with the shell. The curing apparatus is adapted to cure the viscous fluid within the air space such that the cured fluid acts as a constrained layer of mechanical damping within the wall of the ITE shell. The constrained layer is adapted to reduce audible feedback to a wearer of the ITE.

According to various embodiments, the manufacturing apparatus includes rapid prototyping equipment, such as a stereo lithography apparatus (SLA). In one embodiment, the SLA is configured to form a hollow ITE hearing instrument shell directly from computer aided design (CAD) geometry files. The shell is constructed from plastic, in an embodiment. In various embodiments, the port is sized to accommodate a specific type of dispensing apparatus, such as a syringe. The curing apparatus include an ultraviolet (UV) light bath, in an embodiment. In some embodiments if a 2-part silicone is used, it can be heat-cured. In various embodiments it is also possible to do a moisture cure.

Also disclosed herein is an in-the-ear (ITE) hearing instrument. According to various embodiments, the hearing instrument includes a hollow plastic shell and an air space within a wall of the shell. The hearing instrument also includes at least one port in the shell. The port is adapted to interface the air space to an area outside the shell, in an embodiment. A viscous fluid is dispensed within the air space via the port. The fluid is adapted to be cured such that the cured fluid acts as a constrained layer of mechanical damping within the wall of the ITE shell, in various embodiments. The constrained layer adapted to reduce audible feedback to a wearer of the ITE.

According to various embodiments, the air space includes approximately one third (⅓) of an overall thickness of the shell. The cured fluid can include a viscoelastic damping layer and/or an elastomer, in various embodiments. In one embodiment, the cured fluid includes a low-durometer elastomer. The hollow plastic shell includes a base, and the base includes the at least one port in an embodiment.

Figure 1B:
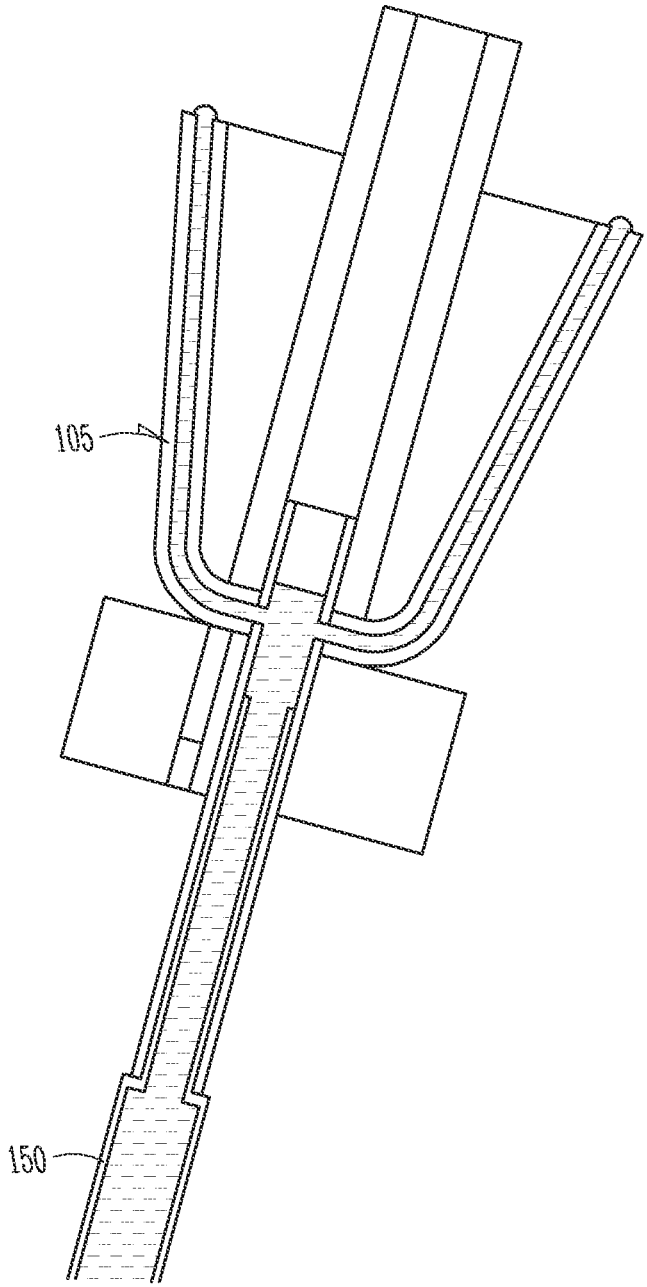

FIG. 1A illustrates a system 100 for constrained layer damping for hearing assistance devices, according to one embodiment. A cross-section of an ITE shell 105 has a dispensing apparatus 110 positioned to inject a viscous fluid into the hollow walls 115 of the shell 105. A syringe 120 is attached to a needle 125 containing side holes and an end-stop 130. The needle 125 is inserted into a larger hole (port 140) at the shell's base, and a compliant stop 145 is used to precisely seat the needle 125 relative to the shell 105. A dispenser or plunger (not shown) is used to push the viscous fluid 150 into the hollow walls 115 of the shell. In FIG. 1B, the viscous fluid 150 has been injected into the ITE shell 105.

Figure 2:
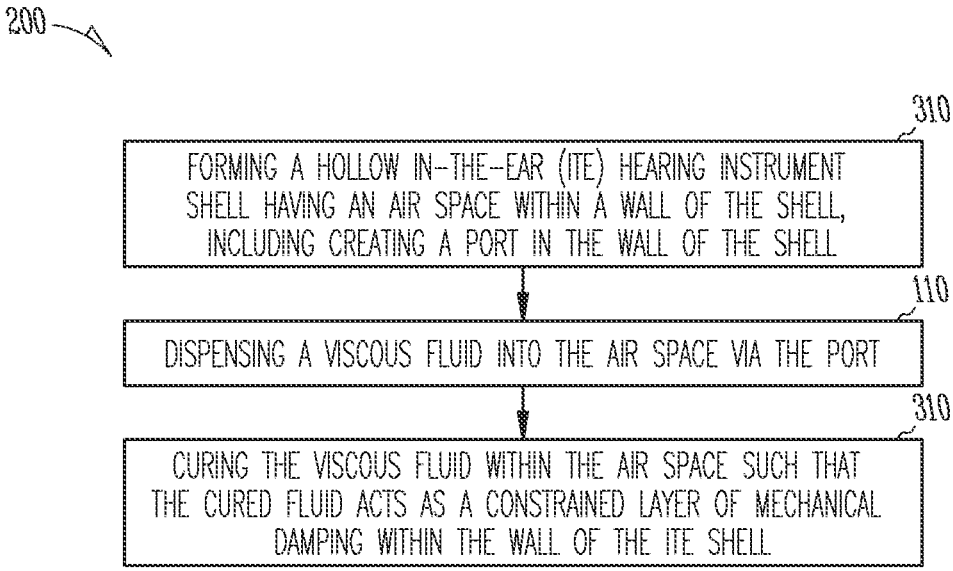
FIG. 2 illustrates a flow diagram for a method for constrained layer damping for hearing assistance devices, according to one embodiment.

FIG. 2 illustrates a flow diagram for a method 200 for constrained layer damping for hearing assistance devices, according to one embodiment. According to various embodiments, a hollow in-the-ear (ITE) hearing instrument shell is formed, at 205. The shell has an air space within a wall of the shell, in various embodiments. A port is created in the wall of the shell. The port is adapted to interface the air space to an area outside the shell, in an embodiment. At 210, a viscous fluid is dispensed into the air space via the port, and the viscous fluid is cured within the air space, at 215. The cured fluid acts as a constrained layer of mechanical damping within the wall of the ITE shell, reducing audible feedback to a wearer of the ITE.

According to various embodiments, the shell with the air space is formed to keep an overall wall thickness approximately equal to a wall thickness of an ITE shell without an air space. The ITE hearing instrument shell is formed using an SLA, in an embodiment According to various embodiments, dispensing a viscous fluid into the air space includes injecting the fluid upward into the shell via the port, and the port is in a base of the shell. Injecting the fluid includes using a syringe to inject the fluid, and the syringe has a needle sized to fit within the port, in various embodiments. An ultraviolet (UV) light bath is used to cure the liquid, in an embodiment.

Various embodiments of the hearing instrument shell of the present subject matter are suitable for containing various hearing aid components, such as a receiver assembly, a signal processor, a microphone housing, a cover and battery. In various embodiments, additional hearing aid components may be included. In one example, a telecoil is included. Another example includes a wireless transceiver adapted for wireless communications with a hearing aid programmer or another hearing aid. Various embodiments can include combinations of these devices. Further, in various embodiments, hearing aid components are interconnected with conductors. In other embodiments, at least a portion of the conductors needed to interconnect hearing aid components are attached to a flexible substrate. In some embodiments, the hearing aid components are soldered to flexible printed circuitry ("FPC"). Embodiments using FPC can reduce assembly work by enabling a robot to attach components to the FPC. In such embodiments, final hearing aid assembly requires mating the FPC assembly to the shell, and does not require placement of individual hearing aid components within the shell. Some hearing aid designs benefit from a reduced potential for a feedback loop to form between the hearing aid microphone housing and the hearing aid receiver assembly. Therefore, in some designs, the shell is customized to sealingly mate with the individual user's hearing canal. However, it should be understood that the present subject matter also includes standardized shells which are suitable for mating to a hearing canal. It is understood that other hearing assistance devices not expressly stated herein may fall within the scope of the present subject matter It is understood one of skill in the art, upon reading and understanding the present application will appreciate that variations of order, information or connections are possible without departing from the present teachings.

Additionally, one of ordinary skill in the art will understand that, the systems shown and described herein can be implemented using software, hardware, and combinations of software and hardware. As such, the term "system" is intended to encompass software implementations, hardware implementations, and software and hardware implementations.

The present subject matter includes hearing assistance devices, including but not limited to, hearing aids, such as in-the-ear (ITE), in-the-canal (ITC), completely-in-the-canal (CIC), behind-the-ear (BTE), and receiver-in-the-ear (RIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. An in-the-ear (ITE) hearing instrument, comprising:

a rigid hollow plastic shell of the ITE hearing instrument, including a wall;

an air space within the wall of the shell;

at least one port in the shell, the port adapted to interface the air space to an area outside the shell; and a viscous fluid dispensed within the air space via the port, the fluid adapted to be cured such that the cured fluid acts as a constrained layer of mechanical damping within the wall of the ITE shell, the constrained layer adapted to reduce audible feedback in a microphone of the ITE hearing instrument.

2. The hearing instrument of claim 1, wherein the air space includes a thickness of approximately one third (⅓) of an overall thickness of the shell.

3. The hearing instrument of claim 1, wherein the cured fluid includes a viscoelastic damping layer.

4. The hearing instrument of claim 1, wherein the cured fluid includes an elastomer.

5. The hearing instrument of claim 4, wherein the cured fluid includes a low-durometer elastomer.

6. The hearing instrument of claim 1, wherein the hollow plastic shell includes a base, and the base includes the at least one port.

7. The hearing instrument of claim 1, wherein the at least one port is sized to accommodate a specific type of dispensing apparatus.

8. The hearing instrument of claim 7, wherein the dispensing apparatus includes a syringe.

9. The hearing instrument of claim 1, wherein the hollow plastic shell with the air space is formed to have an overall wall thickness approximately equal to a wall thickness of an ITE shell without an air space.

10. The hearing instrument of claim 6, wherein the viscous fluid is configured to be injected upward into the shell via the port in the base.

11. The hearing instrument of claim 1, wherein the hollow plastic shell is configured to be manufactured using rapid prototyping equipment.

12. The hearing instrument of claim 11, wherein the rapid prototyping equipment includes a stereo lithography apparatus (SLA).

13. The hearing instrument of claim 12, wherein the SLA is configured to form a hollow ITE hearing instrument shell directly from computer aided design (CAD) geometry files.

14. The hearing instrument of claim 13, wherein the CAD files are developed using laser scanning to obtain mathematical representations of the ear canal geometry.

15. The hearing instrument of claim 1, wherein the fluid is configured to be cured using an ultraviolet (UV) light bath.

16. The hearing instrument of claim 1, wherein the fluid includes a heated hot-melt configured to harden at room temperature.

17. The hearing instrument of claim 1, wherein the fluid includes a silicone in an uncured state.

18. The hearing instrument of claim 1, wherein the fluid includes a UV curable adhesive in a liquid state.

19. The hearing instrument of claim 1, wherein the shell is customized to sealingly mate with a hearing canal of a wearer of the ITE hearing instrument.

20. The hearing instrument of claim 1, wherein the shell is configured to contain a wireless transceiver adapted for wireless communications with a hearing aid programmer or another hearing instrument.

* * * * *